US006145360A

United States Patent [19]

Honsel et al.

[11] Patent Number: 6,145,360

[45] Date of Patent: Nov. 14, 2000

[54] RIVET SETTING DEVICE

[75] Inventors: Michael H. Honsel; Andreas Nolte, both of Froendenberg, Germany

[73] Assignees: M. H. Honsel Beteiligungs GmbH, Germany; Sartam Industries, Venice, Fla.

[21] Appl. No.: 09/292,878

[22] Filed: Apr. 16, 1999

[30] Foreign Application Priority Data

Apr. 27, 1998 [DE] Germany ..... 198 18 755

[51] Int. Cl.[7] ..... B21J 15/28

[52] U.S. Cl. ..... 72/19.8; 72/449; 72/453.15

[58] Field of Search ..... 72/453.15, 449, 72/453.16, 19.8, 453.17

[56] References Cited

U.S. PATENT DOCUMENTS

| | | | |
|---|---|---|---|
| 3,127,045 | 3/1964 | Tschantz | 72/453.15 |
| 3,397,567 | 8/1968 | Klingler | 72/449 |
| 4,541,266 | 9/1985 | Totsu | 72/449 |
| 5,056,347 | 10/1991 | Wagner | 72/149 |
| 5,473,805 | 12/1995 | Wille | 29/243.526 |
| 5,553,478 | 9/1996 | Di Troia | 72/453.15 |

FOREIGN PATENT DOCUMENTS

| | | |
|---|---|---|
| 61017250 | 6/1984 | Japan . |
| 05026278 | 4/1993 | Japan . |

*Primary Examiner*—David Jones
*Attorney, Agent, or Firm*—Majestic, Parsons, Siebert & Hsue

[57] ABSTRACT

The present invention relates to a rivet setting device having an electric drive motor, at lease one rivet setting means driven by drive motor, at least one rechargeable battery for supplying power to the drive motor, and a circuit for controlling the power supply to the drive motor. To prevent situations in such rivet setting devices where the rivet setting device is blocked due to a battery voltage that is too low, the present invention provides for a circuit which comprises a voltmeter for determining a battery voltage value, and a comparator for comparing the determined battery voltage value with a minimum value of the battery voltage which is stored in a storage means of the circuit, and either when the minimum value is not reached before the performance of a rivet setting operation of the rivet setting means, the power supply can be interrupted with the circuit, or when the minimum value is not reached during a rivet setting operation, the power supply can be interrupted with the circuit after the rivet setting operation has been completed.

23 Claims, 2 Drawing Sheets

RIVET SETTING DEVICE

BACKGROUND OF THE INVENTION

The present invention relates to a rivet setting device.

Such rivet setting devices are in general known from the prior art. Thanks to their rechargeable batteries, these rivet setting devices can be operated independently of a network. The fact that the power consumption of the rivet setting devices is very high presents problems. The rechargeable batteries are therefore emptied at a rather rapid pace. Therefore, it often happens that, during a rivet setting operation, the voltage of the rechargeable batteries drops to such an extent that the rivet setting device stops. Since the device is in the middle of a rivet setting operation, this often has the effect that the rivet setting device gets jammed or blocked. Most of the time, the rivet is still positioned within the rivet setting device, and must be removed with great effort.

SUMMARY OF THE INVENTION

Therefore, it is the object of the present invention to develop a rivet setting device in such a manner that a jamming or blocking of the rivet setting device due to the excessively low voltage of the rechargeable batteries is prevented in a reliable manner.

According to the invention, this object is achieved in that the circuit comprises a voltmeter for determining a battery voltage value and a comparator for comparing the battery voltage value with a minimum value of the battery voltage which is stored in a storage means of the circuit and that either when the minimum value is not reached before the performance of a rivet setting operation of the rivet setting means, the power supply to the drive motor can be interrupted by the circuit, or when the minimum value is not reached during a rivet setting operation, the power supply can be interrupted after the rivet setting operation has been completed.

Such a solution is simple and ensures that the rivet setting device does not stop during a rivet setting operation. Hence, the rivet setting device will only stop after a complete rivet setting operation has been carried out. If the minimum value of the battery voltage is not reached during the rivet setting operation, the rivet setting operation which is just being performed will be completed. It is only then that the rivet setting device will stop. If this value has not been reached before the performance of the rivet setting operation, a rivet setting operation will not be carried out at all.

In an advantageous development of the invention, the circuit may comprise a microcomputer and the storage means may comprise a read-only memory connected thereto. Thanks to such components, the rivet setting device can be produced at low cost.

Moreover, according to the invention, the circuit may comprise a current flow limiter for limiting the current flow to a maximum value. The power consumption of the rivet setting device can be reduced drastically, owing to said current flow limiter. Depending on the intended use, the power consumption can be set to a maximum value. For instance, this maximum value is smaller in the case of rivets having small diameters than in the case of rivets having large diameters.

It may be advantageous when the maximum value is preferably adjustable by the operator. The operator can adjust the rivet setting device individually and thereby reduce the power consumption.

It may be advantageous when the maximum value is adjustable in response to the maximally required pulling force for setting the rivet. The value for the pulling force for setting the rivet is a reliable quantity for adjusting the maximum current flow. This maximum pulling force can, e.g., be gathered from tables, or the like.

Moreover, it may be advantageous when the rivet setting device comprises a switch for preselecting the maximum value. Moreover, the operational comfort can be enhanced.

In an advantageous development, a maximum value can be set in steps. The setting operation becomes clearer and, in addition, can be performed more rapidly.

In an advantageous development of the invention, the power supply can be limited with the circuit in the start phase of the drive motor to at least one preadjustable value. As a result, the power consumption of the rivet setting device can be further decreased. This is of particularly advantage in rivet setting devices comprising rechargeable batteries.

The invention shall now be described in more detail with reference to an embodiment.

DETAILED DESCRIPTION OF THE DRAWINGS

Figure 1:
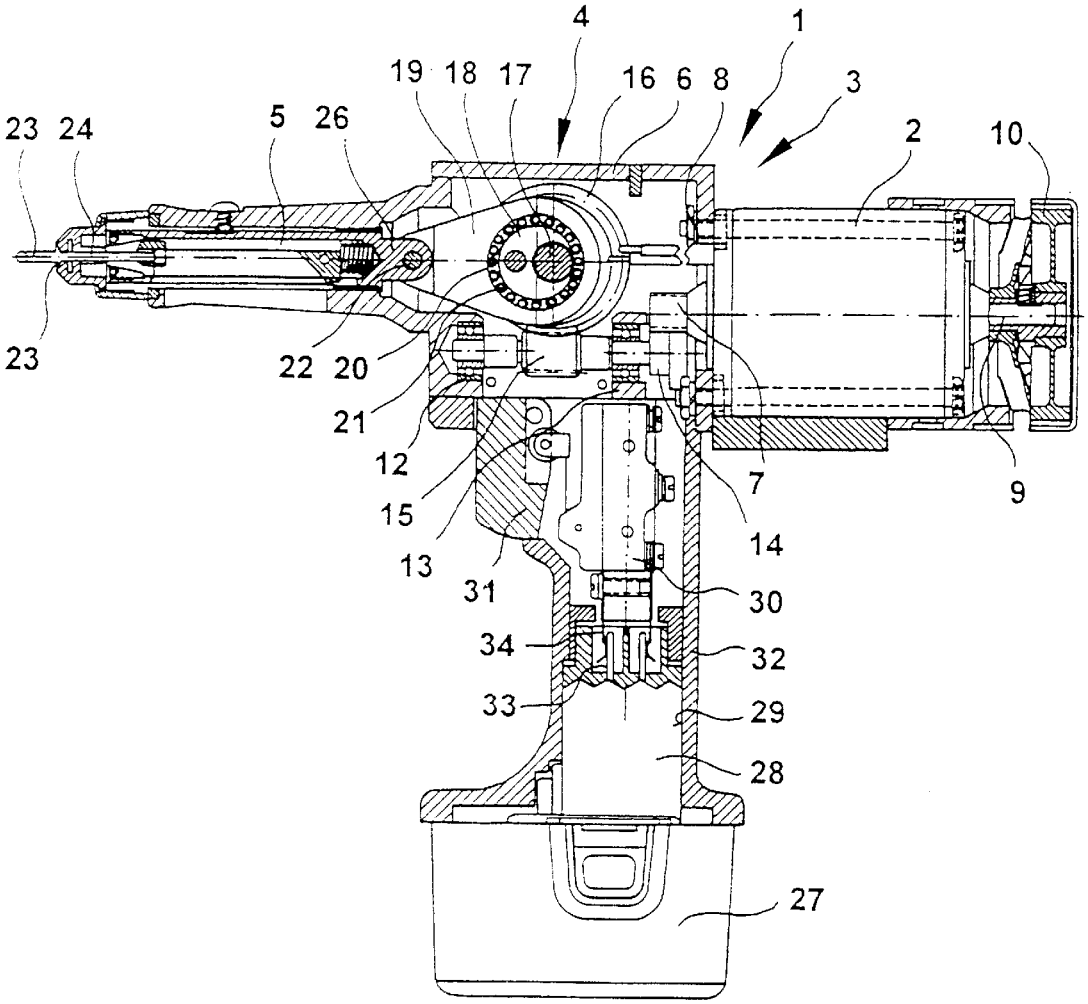
FIG. 1 is a sectional view of a rivet setting device according to the invention.

FIG. 1 is a sectional view of the rivet setting device 1 according to the invention. The rivet setting device 1 comprises an electric motor 2, a transmission 3, a crank drive 4 and a rivet setting means 5. The electric motor 2, the transmission 3, the crank drive 4 and the rivet setting means 5 are arranged in a housing 6 of the rivet setting device 1.

The electric motor 2 is an electric motor which comprises a drive pinion 7 at the side facing the crank drive 4. The electric motor 2 is secured to the housing 6 via a screw union 8. The drive pinion 7 is secured to the motor shaft 9 of the electric motor for rotation therewith, the motor shaft 9 being extended from the electric motor 2 at the side of the electric motor which faces the crank drive. At the side of the electric motor 2 which faces away from the crank drive, a flywheel 10 is mounted on the motor shaft 9 for rotation therewith.

The transmission 3 consists of a transmission shaft 11 which is rotatably supported in the housing 6 at two bearing points 12 and 13. The bearing points 12 and 13 are each provided with ball bearings. The transmission shaft 11 has provided thereon a toothed gear 14 for rotation therewith, said toothed gear 14 meshing with the drive pinion 7, as well as a worm wheel 15. The worm wheel 15 meshes in a toothed gear 16 of the crank drive 4. The crank drive 4 is formed by the toothed gear 16 which is rotatably supported on a shaft 17 which, in turn, is supported in the housing 6. As becomes apparent from FIG. 1, the toothed gear 16 comprises an eccentric 18 which has rotatably supported thereon a connecting rod 19. A ball bearing 21 is positioned between eccentric 18 and an opening 20 in the connecting rod 19. The connecting rod 19 comprises a pin 22 which is hingedly connected to the rivet setting means 5. When the rotational axes of the shaft 17, the eccentric 18 and the pin 22 are arranged in one line, the crank drive is in one of its dead-center positions. When the eccentric 18 is arranged between the shaft 17 and the pin 22, the crank drive is in its front dead-center position; when the shaft 17 is arranged between eccentric 18 and pin 22, the crank drive is in its read dead-center position.

The rivet setting means is known from the prior art. The front end of the rivet setting means has provided thereon an opening 23 into which a blind rivet 24 with a rivet pin 25 can be inserted in the known manner. Since the function of such a rivet setting means is generally known, the means is only shown schematically. In principle, a setting operation is carried out in that a linear movement of a pulling means 26 of the rivet setting means is performed towards the crank drive. This pulling movement is normally designated as a setting stroke. The rivet setting means is configured such that, upon a movement of the crank drive from its rear dead-center position to its front dead-center position, an idle stroke is carried out and it is only when the crank drive is moving from its front dead-center position to its rear dead-center position that the setting stroke is carried out.

Moreover, the rivet setting device 1 is provided with a battery housing 27 which is removably mounted on the housing 6 and has arranged therein rechargeable batteries. The battery housing 27 comprises a pin-like projection 28 which is received in a receiving means 29 of the housing, as shown in FIG. 1.

A switch 30 which is operable by an actuating means 31 is located inside the housing 6. This actuating means 31 is an ordinary push button which operates the switch 30 by being pressed down.

The housing 6 is designed as a handle 32 in the area of the actuating means 31 and between the electric motor 2 and the battery housing 27. The rivet setting device 1 can be held by an operator at the handle 32, with the fingers of the operator's hand operating the actuating means 31.

Contacts 33 which project from the battery housing 27 communicate with contact tongues 34. These contact tongues 34, in turn, communicate with switch 30 and the electric motor 2 via cables (not shown) and with a circuit 45 (also not shown).

Figure 2:
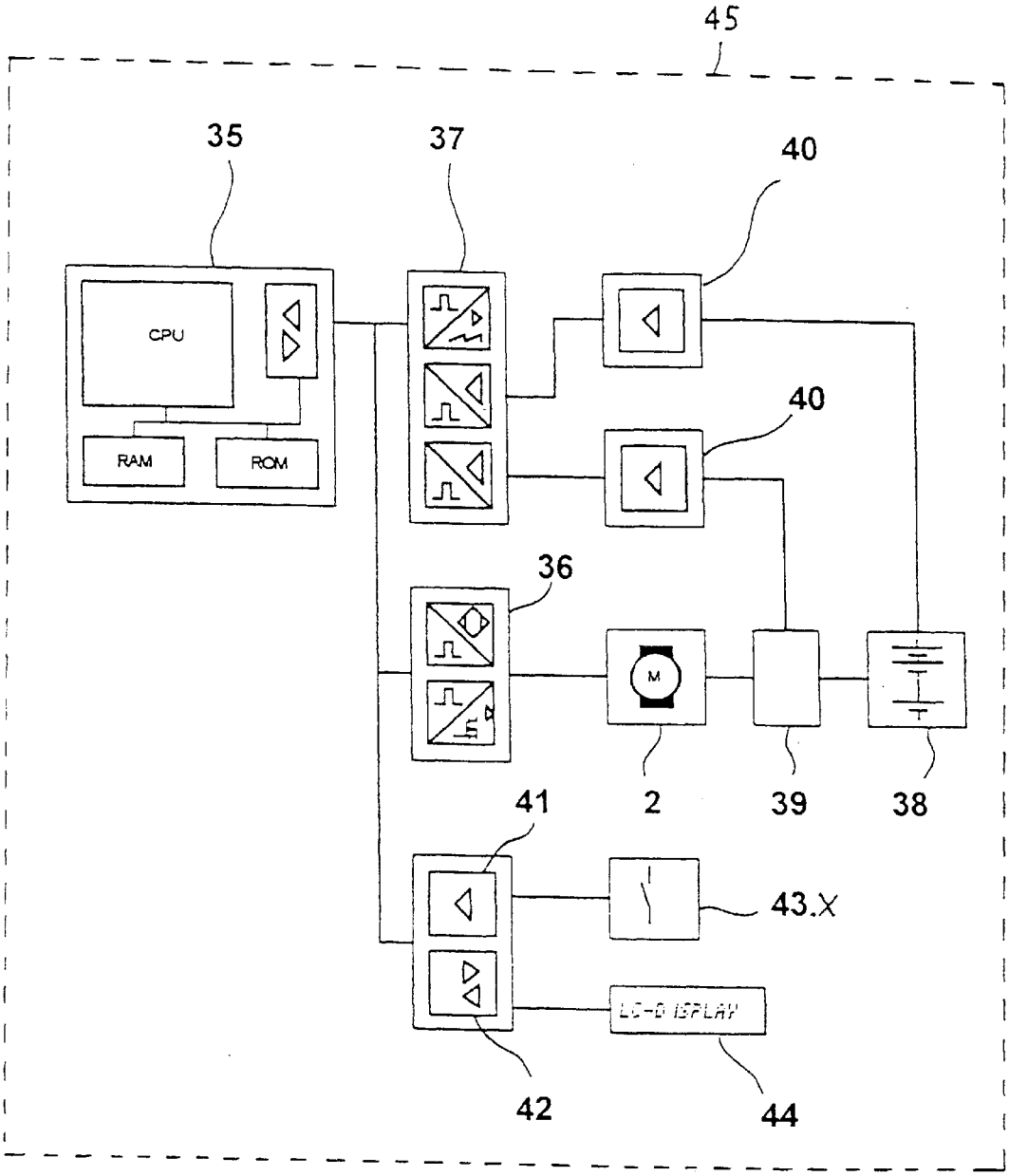
FIG. 2 is a diagrammatic view showing the circuit of the rivet setting device of FIG. 1.

The circuit is an electronic circuit, the principle and structure of which are explained in FIG. 2.

A microcontroller 35 comprising CPU, RAM and ROM is used for controlling the rivet setting device. The motor is activated via power MOSFET transistors 36. The motor is stopped at a defined position via proximity switches and transistors. An AD converter 37 which measures the voltage of the rechargeable batteries 38 and, via a sensor 39, the power consumed by the motor, is integrated into the circuit 45.

Measuring amplifiers 40 are respectively provided between the sensor 39 and the AD converter.

If a residual voltage of the rechargeable batteries is not reached, the power supply to the motor is interrupted and the electric motor is stopped in a defined position.

The microcontroller 35 as used is a kind of microprocessor circuit which comprises a CPU, an internal memory (RAM and EPROM), as well as internal drivers.

The external activation of the microcontrol requires the generation of a timing signal and a reset wiring.

The AD converter consists, on the one hand, of a circuit for generating a sawtooth signal and, on the other hand, of a comparator circuit consisting of sawtooth signal and the output of the measuring amplifiers.

The measuring amplifiers adapted the measurement signal to the level of the sawtooth signal of the AD converter. The voltage of the rechargeable batteries is adjusted with the measuring amplifiers which are assigned to the rechargeable batteries, and further data, such as motor current, force applied to the rivet setting means, etc., can be collected with the measuring amplifiers which are assigned to the MS sensor. The voltage of the rechargeable batteries must be evaluated to prevent any starting of the rivet setting device when the residual capacity is too small. This prevents a blocking of the rivet setting device. When the residual voltage is reached, the motor is stopped in a defined position.

The motor is controlled via the power MOSFET transistor. The motor current in the start phase of the motor is limited via said transistor. When a small motor output is required for an application, the power consumption of the motor can be reduced through the motor control by means of a pulse-width modulation.

Moreover, a proximity switch (not shown in more detail) is provided for detecting a predetermined position of the crank drive 4. In the present case, this is the position in which the crank drive is in its front dead-center position. In this position, the rotational axes of the toothed gear 16 and the eccentric 18 and the pin 22 are positioned in one line, with the eccentric being displaced towards the rivet setting means. Such a control makes is possible to stop the motor in a purposeful manner whenever the crank drive 4 is in its front dead-center position.

Moreover, there are provided drives 41 and 42 which communicate with the microcontroller and the contact switches 43.X and a display means 44. The rivet setting device can be put into and out of operation by means of a key 43.0. The display means 44 can be used for displaying the charge state of the rechargeable batteries. Moreover, it is possible to regulate the maximum power consumption of the motor with the help of these keys 43.X. To this end, a value which is typical of the maximum power consumption of the electric motor 2 can be displayed in the display means. This value can be decreased or increased by keys 43.X. This value can, e.g., be gathered from a table in which the maximum power consumption is compared with the size of the rivet to be processed. Such a table can also be integrated into the rivet setting device and, e.g., be stored in the microcontroller 35. It is then possible to display, e.g., the diameter of the rivet pin of the rivet to be processed in the display means. The value of the diameter of the rivet pin can be increased or decreased accordingly by operating keys 43.X, so that the rivet setting device is set accordingly and the maximum power consumption is limited correspondingly.

The operation and function of the invention shall now be explained in more detail:

An operator who intends to set rivets with the rivet setting device 1 according to the invention will first mount the battery housing 27 in the known manner on the rivet setting device 1, together with the charged and rechargeable batteries arranged in the housing. To this end, the battery housing 27 is inserted with its projection 28 into the receiving means 29 of the rivet setting device 1, with the contacts 33 getting into engagement with the contact tongues 34, whereby power can be supplied to the circuit 45. The operator will then grip with his hand the rivet setting device 1 at handle 32, with one finger of his hand being able to operate the actuating means 31 in a known manner. A blind rivet 24 is subsequently inserted with its rivet pin 25 into the rivet setting means 5 in the known manner.

When the operator presses the actuating means 31 into the housing 6, switch 30 will be operated. Power is thereby supplied to the electric motor 2 via circuit 45. The electric motor which is acted upon by current now transmits its torque via the toothed gear 14 to the transmission shaft 11 and thus to the worm wheel 15 at the same time. The worm wheel meshes in a toothed gear 16 and rotates the eccentric 18. In the initial position of the rivet setting device 1, the rotational axes of shaft 17, eccentric 18 and pin 22 are located along one line, with the crank drive being in its rear dead-center position.

Upon actuation of the drive motor with current, said motor starts so that the crank drive moves from its rear dead-center position to its front dead-center position. Since the rivet setting means is designed such that it performs an idle stroke during this initial movement of the crank drive, the drive motor can start without any problems and can be rotated without the same being already acted upon by pulling forces applied by the rivet setting means. As soon as the crank drive has reached its front dead-center position, the drive motor starts to apply a pulling force to the pulling means 26 of the rivet setting means 5 via the crank drive 4. A rivet setting operation is now performed in the known manner due to this pulling force. The rivet setting operation will be terminated when the crank drive is again in its rear dead-center position, i.e., its initial position. FIG. 1 shows the rivet setting device when the crank shaft is in its front dead-center position, i.e., at the beginning of the setting stroke.

A sensor (not shown) senses the initial position, i.e., when the crank drive is in its rear dead-center position and automatically interrupts the power supply when the actuating means is no longer actuated, so that the crank drive is stopped in its rear dead-center position.

A particularly great torque or a particularly great pulling force can be applied, in particular, at the beginning of the setting stroke, through the flywheel which is connected to the drive motor. At the beginning of the rivet setting operation, the force is maximum. Due to the idle stroke during displacement from the rear dead-center position to the front dead-center position, the flywheel can be rotated accordingly. In an alternative embodiment, the rotating flywheel can additionally be connected to the drive motor via an electromagnetic coupling means (not shown). The coupling means can be controlled such that the rotating flywheel is activated at the beginning of a rivet setting operation. As a result, the motor is rotated more rapidly. In addition, the flywheel energy of the flywheel can be used at a delay to overcome the forces prevailing at the beginning of the rivet setting stroke. As soon as the crank drive is in its rear dead-center position, the flywheel can be decoupled again and further rotate independently of the electric motor. The flywheel energy can thereby be stored. This is particularly advantageous during continuous operation of the rivet setting device, because the flywheel can support the start of the motor and the application of the rivet forces. The power consumption can thus be reduced considerably.

Due to the fact that the rivet setting device is stopped in the defined position and is operated from said position, the force conditions during use of the crank drive 4 are particularly advantageous. Since the initial position is electronically sensed, no expensive coupling mechanisms are needed in comparison with conventional solutions. The electric motor 2 can be in permanent engagement with the crank drive 4 and the transmission 3.

The circuit 45 additionally ensures that, prior to the performance of any rivet setting operation, the instantaneous voltage of the rechargeable batteries is first compared with a predetermined minimum value. As long as the voltage of the rechargeable batteries is above said minimum value, it is still possible to carry out a complete rivet setting operation. Should the voltage of the rechargeable batteries fall below said predetermined value, no further rivet setting operation will be carried out. This has the advantage that the voltage of the rechargeable batteries will not break down during a rivet setting operation and that the rivet setting device will not be blocked thereby. Such constant comparing and monitoring operations for the voltage of the rechargeable batteries are carried out automatically by the circuit 45. The capacity of the rechargeable batteries can thus be used in an optimum manner without the risk that the rivet setting device will be blocked during a rivet setting operation due to insufficient voltage.

Moreover, it is possible through the keys 43.X to limit the maximum power consumption, depending on the respective use of the rivet setting device 1. To this end, a value which is typical of the specific application is indicated in the display means 44, which may, e.g., be an LCD display; this value can, e.g., be the diameter of the rivet pin 25. In cases where blind rivets are to be processed at a predetermined rivet pin diameter, the key 43.2 and the key 43.3, respectively, will be operated until the corresponding value is displayed in the display means 44; key 43.2, for example, can be used for increasing the display value in the display means 44, i.e., when larger diameters are to be processed, and key 43.3 can be used for decreasing the display value. The diameter sizes of the rivet pins are displayed step by step. For instance, the next-greater rivet pin diameter can be displayed by pressing key 43.2 once. Likewise, the next-lower display value or rivet pin diameter can be displayed by pressing key 43.3.

Moreover, during operation of the rivet setting device 1, the instantaneous charge state of the rechargeable batteries can be read with the help of the display means 44.

It is to be understood that while the invention has been described above in conjunction with preferred specific embodiments, the description and examples are intended to illustrate and not limit the scope of the invention, which is defined by the scope of the appended claims.

What is claimed is:

1. A rivet setting device comprising:

an electric drive motor, at least one rivet setting means driven by said drive motor, at least one rechargeable battery for supplying power to said drive motor, and a circuit for controlling the power supply to said drive motor, said circuit comprising:

a voltmeter for determining a voltage value of the battery, and a comparator for comparing the determined voltage value with a minimum voltage value of the battery which is stored in a storage means of said circuit, wherein when said minimum voltage value is not reached before a rivet setting operation of said rivet setting means is performed the power supply to said drive motor can be interrupted with said circuit, and further wherein when said minimum voltage value is not reached during a rivet setting operation the power supply to said drive motor can be interrupted after the rivet setting operation has been completed.

2. The rivet setting device according to claim 1, wherein said circuit comprises a microcomputer and the storage means comprises a read-only memory connected thereto.

3. The rivet setting device according to claim 1, wherein said circuit comprises a current flow limiter for limiting the current flow to a maximum value.

4. The rivet setting device according to claim 3, wherein the maximum value is preferably adjustable by the operator.

5. The rivet setting device according to claim 3, wherein the maximum value is adjustable in response to the maximally required pulling force for setting the rivet.

6. The rivet setting device according to claim 3, wherein said rivet setting device comprises a switch for preselecting the maximum value.

7. The rivet setting device according to claim 3, wherein the maximum value is adjustable in steps.

8. The rivet setting device according to claim 1, wherein in a start phase of said drive motor a current supply can be limited by the circuit to at least one preset value.

9. A rivet setting device comprising:

an electric drive motor, at least one rivet setting means driven by said drive motor, at least one rechargeable battery for supplying power to said drive motor, and a circuit for controlling the power supply to said drive motor, said circuit comprising:

a voltmeter for determining a voltage value of the battery, a comparator for comparing the determined voltage value with a minimum voltage value of the battery which is stored in a storage means of said circuit, wherein when said minimum voltage value is not reached before a rivet setting operation of said rivet setting means is performed the power supply to said drive motor can be interrupted with said circuit, further wherein when said minimum value is not reached during a rivet setting operation the power supply to said drive motor can be interrupted after the rivet setting operation has been completed, a microcomputer, wherein the storage means comprises a read-only memory connected to said microcomputer, and current flow limiter for limiting the current flow to a maximum value, wherein the maximum value is preferably adjustable by the operator, and further wherein the maximum value is adjustable in response to the maximally required pulling force for setting the rivet, and a switch for preselecting the maximum value, wherein the maximum value is adjustable in steps, and further wherein in a start phase of said drive motor a current supply can be limited by the circuit to at least one preset value.

10. A rivet setting device comprising:

an electric drive motor, at least one rivet setting means driven by said drive motor, at least one rechargeable battery for supplying power to said drive motor, and a circuit for controlling the power supply to said drive motor, said circuit comprising:

a voltmeter for determining a voltage value of the battery, a comparator for comparing the determined voltage value with a minimum voltage value of the battery which is stored in a storage means of said circuit, wherein when said minimum voltage value is not reached before a rivet setting operation of said rivet setting means is performed the power supply to said drive motor can be interrupted with said circuit, and further wherein when said minimum value is not reached during a rivet setting operation the power supply to said drive motor can be interrupted after the rivet setting operation has been completed, and a current flow limiter for limiting the current flow to a maximum value.

11. The rivet setting device according to claim 10, wherein said circuit comprises a microcomputer and the storage means comprises a read-only memory connected thereto.

12. The rivet setting device according to claim 10, wherein the maximum value is preferably adjustable by the operator.

13. The rivet setting device according to claim 10, wherein the maximum value is adjustable in response to the maximally required pulling force for setting the rivet.

14. The rivet setting device according to claim 10, wherein said rivet setting device comprises a switch for preselecting the maximum value.

15. The rivet setting device according to claim 10, wherein the maximum value is adjustable in steps.

16. The rivet setting device according to claim 10, wherein in a start phase of said drive motor a current supply can be limited by the circuit to at least one preset value.

17. A rivet setting device comprising:

an electric drive motor, at least one rivet setting means driven by said drive motor, at least one rechargeable battery for supplying power to said drive motor, and a circuit for controlling the power supply to said drive motor, said circuit comprising:

a voltmeter for determining a voltage value of the battery, a comparator for comparing the determined voltage value with a minimum voltage value of the battery which is stored in a storage means of said circuit, wherein when said minimum voltage value is not reached before a rivet setting operation of said rivet setting means is performed the power supply to said drive motor can be interrupted with said circuit, further wherein when said minimum value is not reached during a rivet setting operation the power supply to said drive motor can be interrupted after the rivet setting operation has been completed, and further wherein in a start phase of said drive motor a current supply can be limited by the circuit to at least one preset value.

18. The rivet setting device according to claim 17, wherein said circuit comprises a microcomputer and the storage means comprises a read-only memory connected thereto.

19. The rivet setting device according to claim 17, wherein said circuit comprises a current flow limiter for limiting the current flow to a maximum value.

20. The rivet setting device according to claim 19, wherein the maximum value is preferably adjustable by the operator.

21. The rivet setting device according to claim 19, wherein the maximum value is adjustable in response to the maximally required pulling force for setting the rivet.

22. The rivet setting device according to claim 19, wherein said rivet setting device comprises a switch for preselecting the maximum value.

23. The rivet setting device according to claim 19, wherein the maximum value is adjustable in steps.

* * * * *